United States Patent [19]

Santo

[11] Patent Number: 4,961,237

[45] Date of Patent: Oct. 9, 1990

[54] DEVICE FOR REDUCING WAVE MOTION IN A WATERBED MATTRESS

[76] Inventor: Philip J. Santo, 12 Mountain Rd., Rochester, N.Y. 14625

[21] Appl. No.: 357,799

[22] Filed: May 30, 1989

Related U.S. Application Data

[63] Continuation-in-part of Ser. No. 158,642, Feb. 19, 1988, abandoned.

[51] Int. Cl.[5] ..... A47C 27/08

[52] U.S. Cl. ..... 5/450; 5/451

[58] Field of Search ..... 5/450, 451, 452, 422, 5/457, 458

[56] References Cited

U.S. PATENT DOCUMENTS

| | | | |
|---|---|---|---|
| 4,577,356 | 3/1986 | Johinning et al. | 5/450 |
| 4,607,404 | 8/1986 | Fraige | 5/450 |
| 4,751,757 | 6/1988 | Moreno | 5/451 |

OTHER PUBLICATIONS

"Delastra", an ad in the Flotation Sleep Industry Magazine (9/82) for the Royale Mattress.

*Primary Examiner*—Alexander Grosz
*Attorney, Agent, or Firm*—Lawrence P. Kessler

[57] ABSTRACT

A device for reducing the wave motion in a waterbed mattress which provides optimum firm and conforming feel to the user, while not promoting fungi or algae growth and being capable of allowing the mattress to be substantially completely drained. The wave motion reducing device comprises at least one compartment including a top wall, a bottom wall, and a marginal perimeter wall interconnecting the top wall and the bottom wall to form an enclosed chamber. The bottom wall and the marginal perimeter wall respectively define at least one opening therethrough, the opening being of a dimension to enable a minimum fluid flow into and out of the chamber and inhibit transient fluid flow into and out of the chamber. A buoyant insert is operatively connected to the top wall to urge the compartment toward the top of such bladder. The buoyant insert includes a member having a plurality of uniformly sized air entrapping cells. The cells serve to constantly urge the compartment toward the top surface of the mattress and do not interact with the water so that fungi and algae growth are prevented.

13 Claims, 2 Drawing Sheets

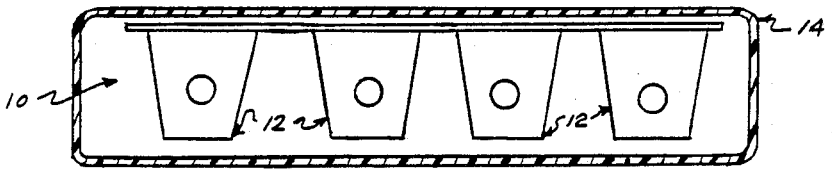
FIG. 1
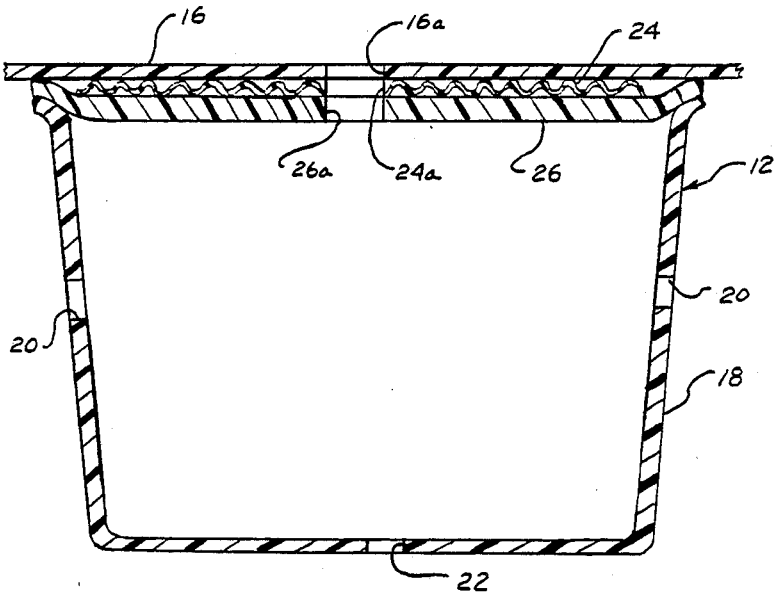
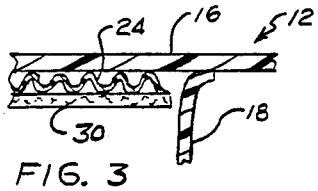
FIG. 3
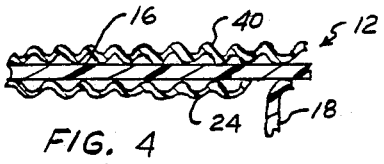
FIG. 4

DEVICE FOR REDUCING WAVE MOTION IN A WATERBED MATTRESS

RELATED APPLICATIONS

This application is a continuation-in-part of my copending patent application Ser. No. 158,642, filed Feb. 19, 1988 now abandoned. Further, this appplication is related to my copending U.S. patent applications Ser. No. 158,639, entitled BOUANI INSERT FOR A WATERBED MATTRESS, and Ser. No. 158,641, entitled INTERACTIVE AIR ENCAPSULATING STRUCTURE, files on Feb. 19, 1988 now U.S. Pat. No. 4,869,939.

BACKGROUND OF THE INVENTION

This invention relates in general to a device for reducing wave motion in waterbed mattresses, and more particularly to a wave reducing device of the hydraulic chamber type having a bouyant insert to locate the hydraulic chamber for optimum wave motion reduction.

Floatation sleep systems, commonly referred to as waterbeds, have become a popular alternative to conventional bedding due to their ability to give a more comfortable and relaxing sleep. This superior sleep is attributable, at least in part, to the substantially uniform pressure distribution exerted on the body when lying on the surface of the waterbed mattress. However, historically, objections to waterbeds have been based primarily on their propensity for extensive surface movement when a body supported on the mattress bladder changes position. The extensive movement is due to reflected wave action of the water within the bladder, initially induced by the changing of the location of displacement when the supported body moves on the surface of the bladder. Recent attempts to reduce wave motion have included utilizing a filler material, such as fiber and foam for example, within the bladder of the waterbed mattress. Such material has certain drawbacks which make their use less than desireable. Specifically, the fiber and foam react with the water to promote the growth of fungi and algae, and further they retain water so that complete draining of the bladder is not possible.

Another mechanism by which reduction of wave motion has been attempted is the inclusion of a device within the bladder which acts as a baffle to the flow of water within the bladder. One particularly effective baffle device is typically referred to as an hydraulic chamber. The hydraulic chamber comprises a compartment having a plurality of ports for allowing the water to move in and out of the compartment. The ports are of sufficient size to enable the water to move relatively freely into and out of the comparrtment when the mattress bladder is filled or drained, but restricts rapid transient flow of water induced by movement of a body supported on the surface of the mattress.

An example of a typical hydraulic chamber is shown in U.S. Pat. No. 4,607,404 (issued Aug. 26, 1986, in the name of Fraige). The hydraulic chamber of such patent includes a buoyant insert of interbonded, non-woven polyester fiber. The bouyant insert serves to float the top of the chamber just below the top surface of the mattress with the chamber hanging downwardly toward the bottom of the mattress. Such location of the chamber, enables the top surface of the mattress to exhibit a desireable feel to a body supported on the mattress. However, hydraulic chambers with buoyant inserts of this construction take time to stabalize against the top surface of the mattress when subjected to body movement on the surface, and further are subject to the above noted disadvantages of fiber in the water environment of the waterbed mattress.

SUMMARY OF THE INVENTION

This invention is directed to a device for reducing the wave motion in a waterbed mattress which provides an optimum firm and conforming feel to the user, while not promoting fungi or algae growth and being capable of allowing the mattress to be substantially completely drained. The wave motion reducing device comprises at least one compartment including a top wall, a bottom wall, and a marginal perimeter wall interconnecting the top wall and the bottom wall to form an enclosed chamber. The bottom wall and the marginal perimeter wall respectively define at least one opening therethrough, the opening being of a dimension to enable a minimum fluid flow into and out of the chamber and inhibit transient fluid flow into and out of the chamber. A buoyant insert is operatively connected to the top wall to urge the compartment toward the top of such bladder. The bouyant insert includes a member having a plurality of uniformly sized air entrapping cells. The cells serve to constantly urge the hydraulic chamber toward the top surface and do not interact with the water so that fungi and algae growth are prevented.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1 is a side elevational view, in cross-section, of a waterbed mattress containing an hydraulic chamber arrangement constructed according to this invention;

FIG. 2 is a side elevational, in cross-section and on an enlarged scale, of an hydraulic chamber acording to this invention;

FIG. 3 is a side elevational view, in cross-section of a portion of an alternate embodiment of the hydraulic chamber according to this invention;

FIG. 4 is a side elevational view, in cross-section, of still another embodiment of the hydraulic chamber according to this invention;

DESCRIPTION OF THE PREFERRED EMBODIMENTS

Figure 6:
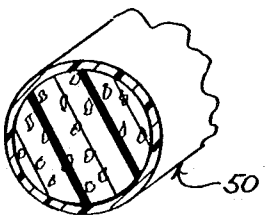
FIG. 6 is an alternate embodiment of the tube of the embodiment of this invention shown in FIG. 5.

Referring now to the accompanying drawings, the device for reducing wave motion in a waterbed mattress according to this invention is designated generally by the numeral 10. As best shown in FIG. 1, the device 10 includes a plurality of interconnected hydraulic cylinders 12 located within the interior of a waterbed mattress 14. The hydraulic cylinders 12 are constructed as a unit having a common top sheet 16 formed of a flexible, substantially dimensionally stable material such as polyethelene or polyvinylchloride for example.

Each of the hydraulic cylinders 12 are of the same configuration, and as such, the detailed construction of only one cylinder is herein shown and described, with the remaing cylinders being of substantially identical construction. In FIG. 2, a first preferred embodiment of the hydraulic cylinder 12 is shown as including a bucket portion 18 connected to the top sheet 16. The bucket portion 18 is preferrably formed of the same material as the top sheet so that the interconnection of the bucket portion to the top sheet can be accomplished by heat sealing for example. Of course, the material of the bucket portion may be of a different material from that of the top sheet, with the interconnection being effected in any other well known manner such as by riveting or gluing for example. The bucket portion 18 has openings 20 respectively formed in the marginal side walls, and an opening 22 formed in the bottom wall. The openings are of a particular size so as to enable substantially unrestricted water movement into and out of the bucket portion when the mattress 14 is filled or drained, and yet restrict a more rapid water flow due to transients generated by the movement of a body on the top surface of the mattress. In this manner the bucket portion 18 will act to dampen wave motion in the water of the mattress caused by such body movement.

In order to maintain the bucket portion 18 in substantially constant effective contact with the top surface of the waterbed mattress 14, the hydraulic cylinder 12 includes a buoyant insert member 24. The buoyant insert member 24 is securred in place against the bottom side of the top sheet 16 by a retaining sheet 26. The retaining sheet 26 is also desireably formed of the same material as the top sheet so that it can similarly be joined to the top sheet and bucket portion by heat sealing for example. Of course it is contemplated by this invention that the buoyant insert member 24 could be formed of the same material as that of the top sheet 16 so that the member 24 could be directly joined to the top sheet and bucket portion by heat sealing for example. The top sheet 16, Buoyant insert member 24, and retainer sheet 26 respectively have openings **16*a*, 24*a*, and 26*a* aligned to provide a restricted water flow passage into and out of the bucket portion 18 through the top thereof. This passage allows air to escape from the bucket portion 18 when the mattress 14 is first filled, and a limited amount of water to flow over the top of the top sheet 16 when the cylinder 12 is forced downwardly by a body on the surface of the mattress 14** to further dampen the wave motion within the mattress.

The buoyant insert member 24 is a sheet of air encapsulating cellular material. As shown, the cellular material has a plurality of uniformly sized cells of substantially hemispherical shape with the apexes of the cells directed toward the top surface of the mattress. Of course, other configurations of cells for the cellular material, such as elongated tubes for example, are suitable for use with this invention. The cellular material is of a highly buoyant nature and will accordingly act constantly to urge the the hydraulic cylinder 12 upwardly toward the desired contact with the top surface of the mattress 14. Even direct application of a downward force due to a body located directly over the particular cylinder will not substantially cause the cylinder to move away from the top surface of the mattress. Thus, the body supported on the mattress will always perceive a firm yet body-conforming feel. This is the most desireable surface feel for inducing optimum sleep. Moreover, due to the fact that the material of the buoyant insert 24 is nonabsorbing yet fully compatible with water, no fungi or algae growth will be promoted. Also, this non absorbing quality will enable the mattress to be substantially fully drained when desired.

In the alternate embodiment of the hydraulic cylinder according to this invention shown in FIG. 3, a layer of closed cell foam 30 is attached to the buoyant insert member 24. This closed cell foam 30 provides an enhanced degree of rigidity to the hydraulic cylinder whereby the overall surface of the device 10 is more uniform. In the alternate embodiment of the hydraulic cylinder according to this invention shown in FIG. 4, an additional layer 40 of the air encapsulated cellular material is attached to the top surface of the top sheet 16. The individual cells of this additional layer 40, maintained in contact with the top surface of the mattress 14 due to their bouant nature, serve to give an enhanced feeling a body-hugging conformity to the body supported on the mattress.

Figure 5:
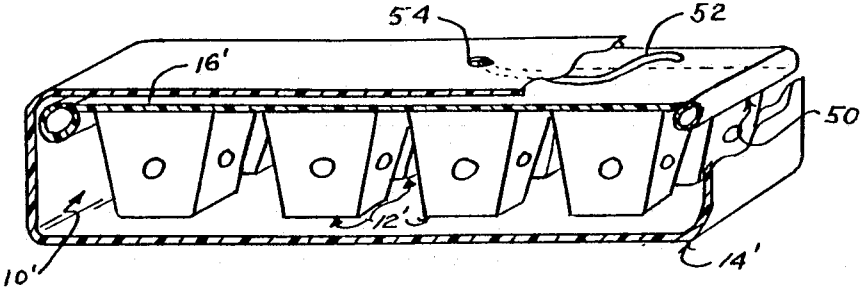
FIG. 5 is a view in perspective of a cross-section of a further embodiment of a waterbed mattress containing an hydraulic chamber arrangement constructed according to this invention.

FIGS. 5 and 6 show a further embodiment of the device for reducing wave motion, designated by the numeral 10'. The device 10' includes a hydraulic cylinder unit containing a number of interconnected hydraulic cylinders 12', of any of the types described above with reference to FIGS. 2–4. However, in this embodiment the perimeter of the hydraulic cylinder unit has a tube 50 connected thereto. The tube 50 is formed of the same material as the top sheet 16' of the hydraulic cylinders 12' so that it can be joined to the top sheet by heat sealing for example. Of course, the tube 50 could be connected to the top sheet 16' by any other well known mechanisms such as gluing or stapling for example.

The tube 50 is adapted to be pressurized, with air for example, so as to maintain its tubular configuration when the device 10' is located in a fluid-filled waterbed mattress. For example, the tube may have an umbilcal cord 52 accessable through the mattress fill valve 54. At the appropriate time (when the mattress is filled with fluid), the tube 50 can be pressurized by being connected to a pressurized air source. Of course, the tube could alternatively be filled with a material, such as foam for example, the only requisite being that the material is buoyant to accomplish the described functions for the tube.

When the tube is pressurized, it serves to maintain the device 10' in proper orientation within the mattress so that the hydraulic cylinders 12' are located (and fillable with fluid) for effective operation. Further, the tube 50 serves as an edge perimeter support for the mattress such that the mattress has a highly desireable feel to the user, with or without the mattress being located within a rigid frame. This arrangement facilitates the use of a pair of mattresses in side-by-side relation for a dual assembly, in that the tube sections in juxtaposition with the adjacent perimeter walls of the mattresses support the mattresses at the center for comfortable support of the user on each mattress. Additionally, a single mattress could contain a pair of wave reducing devices with the associated tubes to support the center of the mattress in a similar manner as the described dual mattress arrangement.

The invention has been described in detail with particular reference to a preferred embodiments thereof, but it will be understood that variations and modifications can be effected within the spirit and scope of the invention.

I claim:

1. In a waterbed mattress free of water absorbing foam or fibrous materials including a bladder adapted to contain water, a device located within such bladder for reducing wave motion of water within such bladder, said wave reducing device comprising:

at least one compartment including a top wall, a bottom wall, and a marginal perimeter wall interconnecting said top wall and said bottom wall to form an enclosed chamber;

said bottom wall and said marginal perimeter wall respectively defining at least one opening therethrough, said openings being of a dimension to enable a minimum fluid flow into and out of said chamber and substantially restrict transient fluid flow into and out of said chamber; and a buoyant insert operatively connected to said top wall to urge said compartment toward the top of such bladder, said buoyant insert including a nonabsorbing, water compatible member having a plurality of air entrapping hemispherical cells of uniform size.

2. The invention of claim 1 wherein said member is joined to the under side of the top wall of said compartment.

3. The invention of claim 2 wherein said member is joined to the upper and lower side of the top wall of said compartment.

4. The invention of claim 3 wherein the respective apexes of said hemispherical cells are directed toward the top of such bladder.

5. The invention of claim 1 wherein said member is joined to the upper side of the top wall of said compartment.

6. The invention claim 5 wherein the respective apexes of said hemispherical cells are directed toward the top of such bladder.

7. The invention of claim 1 wherein said wave reducing device includes a plurality of compartments joined at the respective top walls thereof.

8. The invention of claim 7 further including a buoyant tube surrounding the perimeter of the joined plurality of compartments and connected thereto.

9. The invention of claim 8 wherein said tube is selectively connectable to a source of pressurized air to provide pressurization of said tube whereby said tube is given its buoyant nature.

10. The invention of claim 8 wherein said tube contains buoyant foam.

11. In a waterbed mattress including a bladder adapted to contain water, a device located within such bladder for reducing wave motion of water within such bladder, said wave reducing device comprising:

a plurality of compartments respectively including a top wall, a bottom wall, and a marginal perimeter wall interconnecting said top wall and said bottom wall to formed an enclosed chamber; said bottom wall and said marginal perimeter wall respectively defining at least one opening therethrough, said openings being of a dimension to enable a minimum fluid flow into and out of said chamber and substantially restrict transient fluid flow into and out of said chamber; and a buoyant insert operatively connected to said top wall to urge said compartment toward the top of such bladder, said buoyant insert including a nonabsorbing, water compatible member having a plurality of air entrapping cells of uniform size; and a buoyant tube surrounding the joined plurality of compartments and connected thereto.

12. The invention of claim 11 wherein said tube is selectively connectable to a source of pressurized air to provide pressurization of said tube whereby said tube is given its buoyant nature.

13. The invention of claim 11 wherein said tube contains bouyant foam.

* * * * *